US005246376A

United States Patent [19]

Schuhl et al.

[11] Patent Number: 5,246,376

[45] Date of Patent: Sep. 21, 1993

[54] ELECTRICAL ADAPTOR

[75] Inventors: Vincent Schuhl, Le Vesinet; Jean C. Delamotte, Henonville; Bruno Lemonnier, Cergy, all of France

[73] Assignee: Raychem SA, France

[21] Appl. No.: 16,473

[22] Filed: Feb. 10, 1993

Related U.S. Application Data

[63] Continuation of Ser. No. 874,869, Apr. 28, 1992, abandoned.

[51] Int. Cl.[5] ..... H01R 13/658; H01R 13/59

[52] U.S. Cl. ..... 439/98; 439/462; 439/610

[58] Field of Search ..... 439/98, 99, 461, 462, 439/608, 610

[56] References Cited

U.S. PATENT DOCUMENTS

| | | | |
|---|---|---|---|
| 3,648,222 | 3/1972 | Cowmeadow | 439/608 |
| 3,825,874 | 7/1974 | Peverill | 439/608 |
| 3,990,765 | 11/1976 | Hill | 439/610 |
| 4,109,222 | 8/1978 | Frano et al. | 335/301 |
| 4,144,404 | 3/1979 | De Groef et al. | 174/88 |
| 4,382,653 | 5/1983 | Blanchard | 439/610 |
| 4,615,578 | 10/1986 | Stadler et al. | 439/607 |
| 4,820,201 | 4/1989 | Van Brunt et al. | 439/610 |

FOREIGN PATENT DOCUMENTS

| | | |
|---|---|---|
| 0295154 | 12/1988 | European Pat. Off. . |
| 1234355 | 6/1971 | United Kingdom . |
| 1512626 | 5/1975 | United Kingdom . |
| 1453809 | 10/1976 | United Kingdom . |

*Primary Examiner*—Gary F. Paumen

*Attorney, Agent, or Firm*—Sheri M. Novack; Herbert G. Burkard

[57] ABSTRACT

An adaptor for an electrical connector which enables the screens of a number of screened electrical wires to be terminated and which will provide electromagnetic shielding for the wires; which comprises: (i) an electrically conductive body having an aperture through which the wires are intended to pass; (ii) an electrically conductive shielding member that can be positioned in the aperture substantially to close the aperture, the member having a plurality of recesses opening onto the periphery; (iii) a plurality of electrically conductive hollow deformable ferrules that are capable of receiving one or more wires so that the wires extend through and beyond the ferrules and the ferrules can be electrically connected to the screen of the wire or wires esxtending therethrough, each ferrule being capable of being held in one of the recesses in the periphery of the shielding member by deformation of the ferrule but being capable of being removed from the recess; (iv) a locking ring that can engage and be tightened on the body in order to retain the shielding member and ferrules in the aperture; and (v) means for holding the ferrules securely in the recesses when the locking ring is tightened on the body.

9 Claims, 3 Drawing Sheets

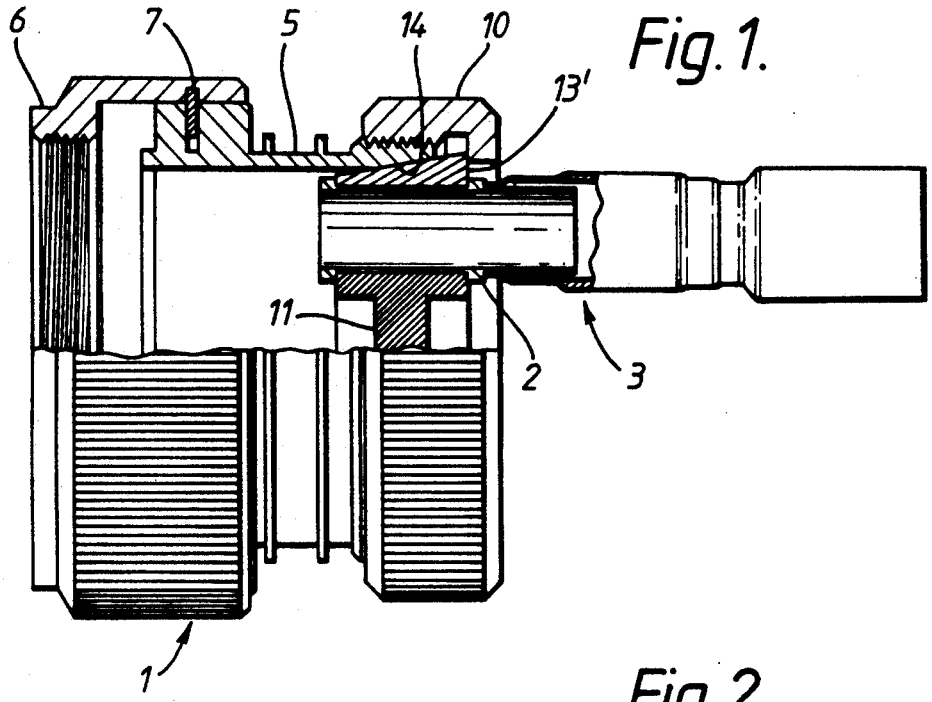
Fig. 1.
Fig. 2.
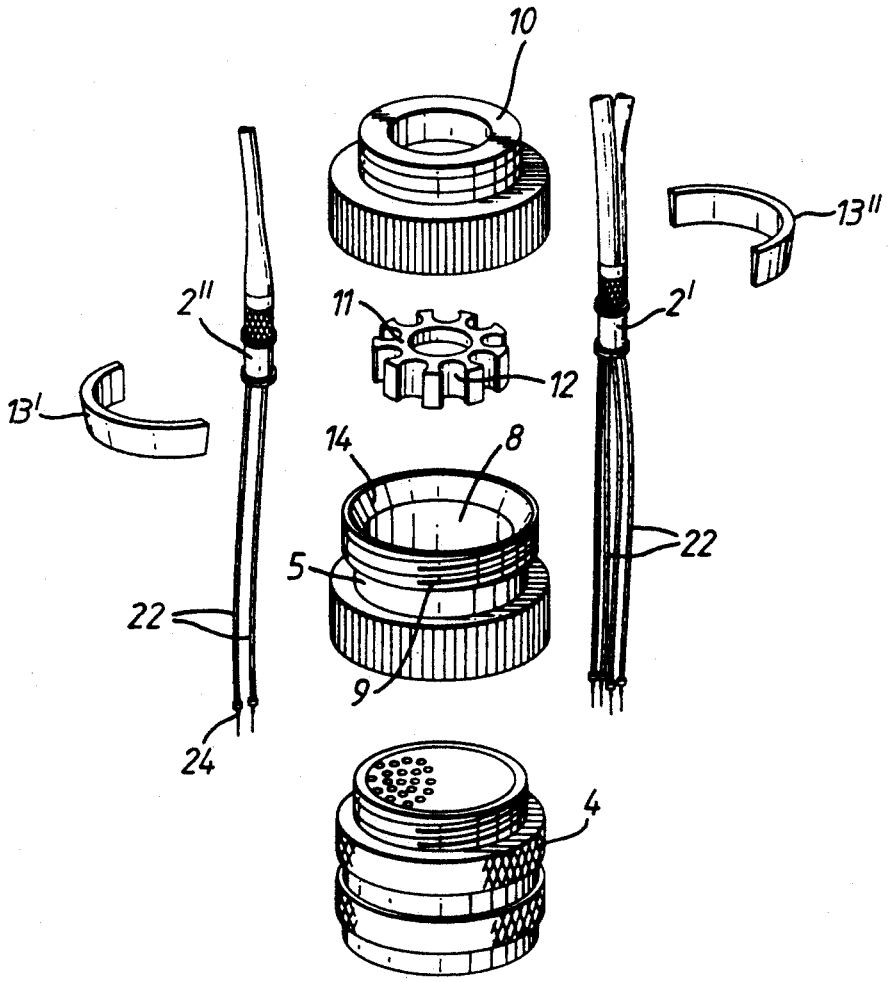

ELECTRICAL ADAPTOR

This application is a continuation of application Ser. No. 07/874,869, filed Apr. 28, 1992, now abandoned.

This invention relates to electrical adaptors and in particular to the provision of electrical adaptors for shielding against electromagnetic interference.

It is common to provide wires with an electrical shield, for example in the form of a metal braid screen, in order to screen the wires from electrical, magnetic or electromagnetic interference, or to prevent interference in neighbouring equipment. A separate screen may be provided for each individual wire, or a single screen may be provided around a bundle of wires.

Where it is desired to terminate a plurality of such wires or bundles of wires, it is necessary not only to connect each of the individual wires but also to earth each of the shields. In order to terminate such a plurality of shielded wires which pass through an aperture, a number of techniques have hitherto been proposed.

Thus it has been proposed to separate the screens from the central wires, and then firmly clamp each of the screens into the aperture. The screens are generally also earthed by the clamping. One such method is described in UK Patent No. 1512626. The method comprises the steps of separating the central wires from their respective shields by passing each insulated wire through an aperture in the braid, by a technique known as "pigtailing", inserting the plurality of screens between the tines of a longitudinally slotted tubular grounding member, and then fastening a heat-shrinkable band of memory-metal (as defined hereinafter) around the tines so that when the band or ring shrinks it causes the slotted portion of the tubular grounding member to contract so that the screens are firmly gripped between the tines.

This method of terminating shielded wires involves connecting the shield of each wire to a grounding lead either by solder device or by a crimp, and joining the individual grounding leads together before connecting them to conductive housing. Alternatively a single grounding lead may be connected to the screens of all the wires and then grounded. These methods also suffer from the disadvantage that they do not permit disassembly once installed and that they are difficult to install, in this case caused largely by the necessity of "centre-stripping" of the wire insulation to obtain access to the shield as some distance from its end. In addition there is the possibility that the grounding leads will act as antennae and pick up electro-magnetic interference. These proposed termination methods also suffer from the disadvantage that they are, at least to some extent, random in that the value of the screening effectiveness may not be reproducible for different terminations.

Yet another method of terminating shielded wires uses the connector device as described in U.S. Pat. No. 4,382,653 to Blanchard. This connector employs a number of ferrules that are connected to the shields and are dip-brazed to a plate that is secured in the housing. This arrangement also cannot be disassembled once it has been formed.

A further form of adaptor is described in European Patent Application No. 295,154. This form of adaptor includes a metal body having an aperture through which the shielded wires pass and a shielding plate that closes the aperture. The shields of the wires are connected to a number of ferrules which can be inserted into recesses in the shielding plate and retained thereon by a retaining plate. The retaining plate is provided with a number of apertures through which the shielded wires extend. This form of adaptor has the advantage that it can be disassembled once it has been formed in order, for example, to alter the wiring connections or to replace a wire. However, assembling the adaptor assembly, both originally and after disassembly, can be quite difficult, since individual screened wires and ferrules must be threaded through the apertures in the retaining plate which requires separation of the retaining plate from the shielding plate with the result that the remaining ferrules are liable to fall out of the recesses in the shielding plate. Thus assembly of the adaptor requires considerable manual dexterity.

According to the present invention there is provided an adaptor for an electrical connector which enables the screens of a number of screened electrical wires to be terminated and which will provide electromagnetic shielding for the wires, which comprises:

(i) an electrically conductive body having an aperture through which the wires are intended to pass;

(ii) an electrically conductive shielding member that can be positioned in the aperture substantially to close the aperture, the member having a plurality of recesses located around the periphery thereof;

(iii) a plurality of electrically conductive hollow deformable ferrules that are capable of receiving one or more wires so that the wires extend through and beyond the ferrule and which can be electrically connected to the screen of the wire or wires extending therethrough, each ferrule being capable of being held in one of the recesses in the periphery of the shielding member by deformation of the ferrule but being capable of being removed from the recess;

(iv) a locking ring that can engage and be tightened on the body in order to retain the shielding member and ferrules in the aperture; and (v) means for holding the ferrules securely in the recesses when the locking ring is tightened on the body.

The adaptor assembly according to the present invention has the advantage that it can provide 360° screening to a high level and can be repeatedly disassembled and assembled with relative ease for example to repair or replace electrical components. When the adaptor assembly is disassembled each ferrule will remain held in a recess of the shielding member unless or until it is specifically removed with the result that it is necessary to hold and manipulate very few items at any time when assembling the adaptor. Thus, it is possible to connect each ferrule individually to its associated wire or wires and then to attach the ferrules with associated wires sequentially to the shielding member by manually pushing them into the recesses. When this has been done and any electrical connections have been made between the wires and the connector, the shielding member can be positioned in the aperture and the locking ring tightened on the adaptor body. This method may be contrasted with the method described in U.S. Pat. No. 4,382,653 in which all the electrical connections to the wire screens must be made together or at least in the close proximity of the other wires, which rapidly becomes extremely difficult as the number of wires increases.

The means for holding the ferrules securely in the recesses of the shielding member preferably operates by exerting a laterally directed force on the ferrules that tends to push the ferrules toward the centre of the shielding member, i.e. that tends to push the ferrules into the recesses. This may, for example, be achieved by forming a number of slits in the adaptor body that extend longitudinally for a short distance from the aperture and forming bevelled surfaces on the parts of the body and locking ring that bear on one another so that, as the locking ring is tightened on the body, those parts of the body that define the aperture are forced inwardly onto the ferrules. Preferably, however, the means for holding the ferrules securely in the recesses of the shielding member comprises an annular compression element that is arranged to encircle the shielding member when the adaptor is assembled and which is caused to decrease in diameter when the locking ring is tightened on the body. The compression element can be provided with a bevelled surface that bears on a corresponding bevelled surface on the adaptor body or locking ring so that it is caused to decrease in diameter when the ring is tightened. The compression element may be formed in one piece in which case it is preferably in the form of a ring having a slit at one point that accommodates the reduction of diameter of the ring. Alternatively, it may be formed as a plurality of sub-members, for example a pair of half rings, that are caused to move together as the ring is tightened. These sub-members may be entirely free of one another or they may be held together by means of a deformable member, e.g. a metal wire, which will allow the sub-members to move slightly when forced together.

The ferrules are preferably resiliently deformable in order that they can be repeatedly removed and held by the shielding member and so that they will not become loose in time due to permanent deformation thereof. This is preferably achieved by providing them with a slot extending along their length that will allow them to deform. The ferrules are preferably held in the recesses in the shielding member by positive locking in which they are deformed by the greatest extent during insertion into, and removal from, the recesses. Preferably also the ferrules and the recesses are so dimensioned that when the ferrules are located in the recesses they are slightly proud of the periphery of the shielding member so that the compression element bears directly on the ferrules.

The adaptor according to the invention preferably includes means for axially locating the ferrules relative to the shielding member. In the preferred embodiment, the ferrules preferably have one or more protuberances and/or ridges which engage the shielding member substantially to prevent relative axial movement of the member and the ferrules. For example, there may be two protuberances on the ferrule such that the ferrule can be inserted into recess with one protuberance lying on one side and the other protuberance on the other side of the shielding member. Preferably the protuberances are in the form of circumferentially extending flanges on the ferrules.

In addition to the ferrules, one or more other shielding elements, referred to herein as "blanks" may be included in the arrangement. The blanks may be used to block any recesses in the shielding member when an insufficient number of wires is to be used with the connector. As examples, blanks may be solid or they may be hollow with one or both ends closed.

One advantage of including blanks in the arrangement according to the invention is that if at a later date it is decided to introduce a further screened wire through the aperture it is a simple operation to replace one of the blanks with a ferrule and the wire.

The hollow elements are preferably provided with a device for forming an electrical connection to the shield of the wire for example a crimp connector or a solder connector or other connector based on a conductive material.

The electrically conductive material is preferably solder, but electrically conductive materials not conventionally regarded as solders may be used. As an example, an adhesive for example a hot-melt adhesive, loaded with electrically conductive particles for example silver flake or carbon particles may be used.

The device for electrically connecting the screen of each wire to its respective ferrule may comprise a heat-recoverable preferably heat-shrinkable sleeve containing an electrically conductive material as described above. Preferably the heat-recoverable sleeve contains solder for example as described in U.S. Pat. No. 4,144,404 the disclosure of which is incorporated herein by reference.

Two adaptors in accordance with the present invention will now be described by way of example with reference to the accompanying drawings in which:

FIG. 1 is a side view, partly in cross-section of one assembled adaptor according to the invention;

FIG. 2 is an exploded view of a similar adaptor as shown in FIG. 1;

Figure 3:
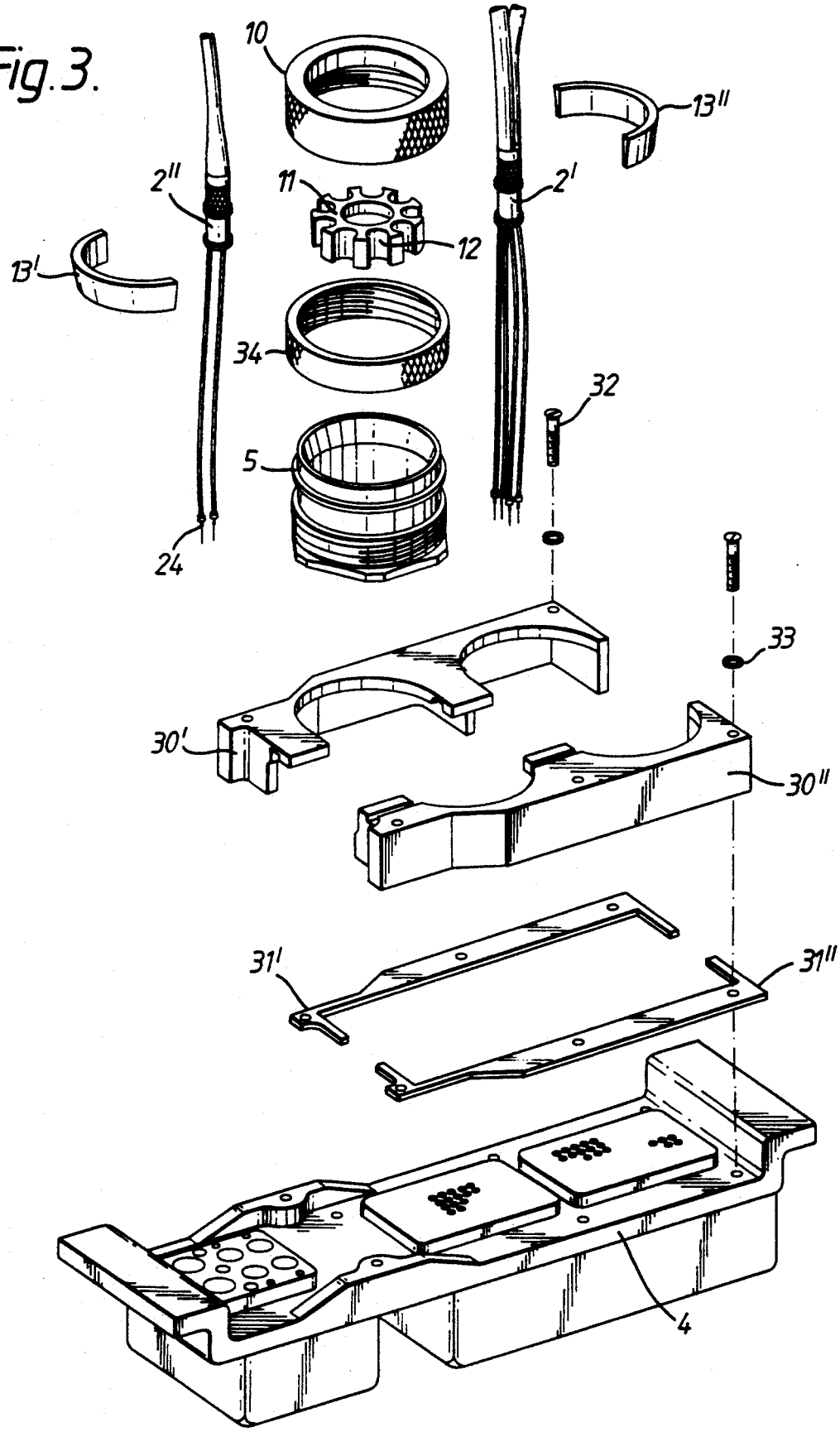
FIG. 3 is an exploded view of a further form of adaptor assembly.

Referring to the accompanying drawings, FIG. 1 shows an assembled adaptor 1 having a single ferrule 2 and associated screen connector 3 extending therefrom. FIG. 2 shows a similar assembly with a pair of ferrules 2' and 2'' and a circular connector 4.

The adaptor comprises a generally cylindrical adaptor body 5 that is provided with a spin-coupling 6 at one end, the spin-coupling being held on the adaptor body by means of a circlip 7. The other end of the body 5 is open-ended defining an aperture 8 and has an external screw thread 9 to enable a locking ring 10 to be screwed onto the body and tightened on it.

The adaptor 1 includes a generally circular shielding member 11 that is substantially the same size as the aperture 8 and has nine generally circular recesses 12 located around its circumference. The recesses 12 have substantially the same size as the ferrules 2 and can snugly receive the ferrules 2 of they are manually pushed into the recesses. When the ferrules 2 are located in the recesses 12 the ferrules lie slightly proud of the circumference of the shielding member 11.

A circular compression ring is provided in the form of a pair of half rings 13' and 13''. The half rings have a tapering external surface that bears on a correspondingly tapering internal surface 14 in the adaptor body when the adaptor is assembled.

Figure 4:
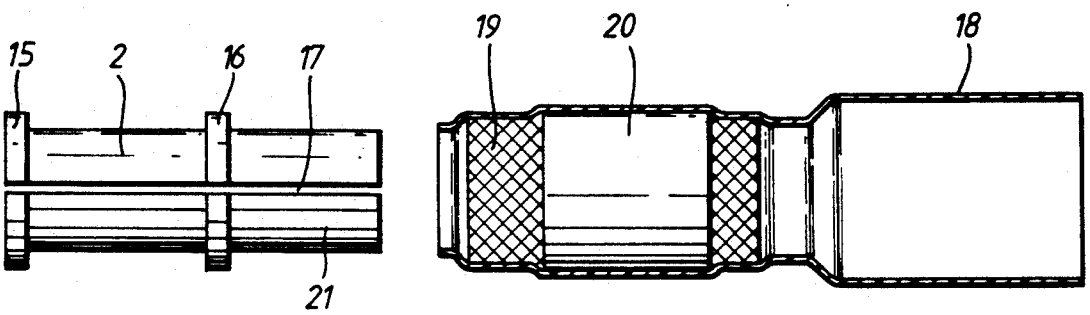
FIG. 4 shows a ferrule and connector employed in the adaptors shown in FIGS. 1 to 3.

A ferrule 2 and connector 3 are shown in FIG. 4. The ferrule 2 is in the form of a hollow circular cylinder having a pair of circular flanges 15 and 16 extending around its periphery and a longitudinal slot 17 extending from one end of the ferrule to the other. The connector 3 for connecting the ferrule 2 to a wire shield comprises a heat-shrinkable polyvinylidine fluoride sleeve 18 that encloses a tinned copped braid 19 that is impregnated with solder, and an additional solder ring 20. The ferrules 2 and connectors 3 may be supplied separately or the connectors 3 may be partially prerecovered onto one end 21 of the ferrule 2 so that the braid 19 is electrically connected to the ferrule.

In order to assemble the adaptor, the jacket and braid of a braided bundle of wires 22 is stripped and the jacket is cut back a little further to expose a short length of the braid. The wires 22 are then passed through the ferrule 2 until the exposed length of braid is located within the braid 19 of the connector. The connector 3 is then heated briefly by means of a hot-air gun or infrared lamp in order to recover the sleeve 18 about the wires and to fuse the solder to form an electrical connection with the braid. The ends of the wires 22 may be terminated with electrical contacts 24 in known manner. The locking ring is pushed over the wires and the ferrules 2 are then pushed into the recesses 12 in the shielding member 11. The body 5 is located over the stripped parts of the wires 22 and, after the wire contacts 24 have been located in appropriate holes in the connector 4 the adaptor body 5 is coupled to the connector 4 by means of the spin coupling 6. The two half rings 13' and 13'' are then positioned about the shielding member 11 and ferrules 2 so that it is axially located between the flanges 15 and 16 on the ferrules. The shielding member 11, ferrules 2 and half rings 13 and 13' are then positioned in the aperture 8 of the adaptor body 5 so that the outer surfaces of the half rings bear on the bevelled inner surface 14 of the adaptor body 5 and the locking ring 10 is screwed onto the thread 9 on the outer surface of the body. As the locking ring 10 is tightened on the adaptor body 5 the two half rings 13' and 13'' are forced toward one another, thereby securing the shielding member 11 and ferrules 2 in position.

In order to replace one of the ferrules 2 and associated wires, the locking ring 10 is simply unscrewed from the adaptor body 5 and the shielding member 11 with ferrules and the half rings 13 and 13' removed from the aperture. The ferrule to be replaced is removed from the shielding member 11 and replaced with a new one. After altering appropriate contacts 24 and the connector 4 the adaptor is reassembled as described above.

FIG. 3 shows a modification of the adaptor according to the invention for use with ARINC 600 type connector. The connector 4, which does not itself form part of the invention has a rear housing formed in tow parts 30' and 30'' which are screwed onto the connector 4 and gasket pieces 31' and 31'' by means of screws 32 and washers 33. Before the rear housing is assembled one end of the adaptor body 5 is inserted into an aperture formed between the housing parts 30' and 30'' and secured by means of screw threaded ring 34. The remainder of the adaptor assembly is as described above with respect to FIGS. 1 and 2.

Figure 5:
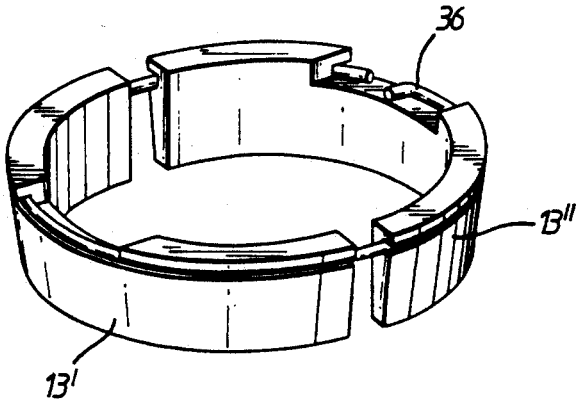
FIG. 5 shows a modified compression element that may be employed with the adaptors shown in FIGS. 1 to 3.

A modification of the annular compression element is shown in FIG. 5. This form of compression element comprises a pair of half rings 13' and 13'' each of which has a groove or shoulder in its outer surface that accommodates a circular loop of wire 36. The loop of wire 36 holds the half rings 13' and 13'' together when the adaptor is in its disassembled state but allows the half rings to move together as the locking ring 10 is tightened in order to hold the ferrules. This form of compression member can be supported by the wires joined to the ferrules 2 during assembly of the adaptor in the same manner as the locking ring 10 and simply slid into place before the locking ring 10 is tightened on the adaptor body, thereby simplifying the assembly of the adapter yet further.

We claim:

1. An adaptor for an electrical connector which enables the screens of a number of screened electrical wires to be terminated and which will provide electromagnetic shielding for the wires, which comprises:

(i) an electrically conductive body having an aperture through which the wires are intended to pass;

(ii) an electrically conductive shielding member that can be positioned in the aperture substantially to close the aperture, the member having a plurality of recesses opening onto the periphery thereof;

(iii) a plurality of electrically conductive hollow deformable ferrules that are capable of receiving one or more wires so that the wires extend through and beyond the ferrules and the ferrules can be electrically connected to the screen of the wire or wires extending therethrough, each ferrule being capable of being held in one of the recesses in the periphery of the shielding member by deformation of the ferrule but being capable of being removed from the recess;

(iv) a locking ring that can engage and be tightened on the body in order to retain the shielding member and ferrules in the aperture; and (v) means for holding the ferrules securely in the recesses when the locking ring is tightened on the body.

2. An adaptor as claimed in claim 1, wherein the means for holding the ferrules securely in the recesses comprises an annular compression element that is arranged to encircle the shielding member when the adaptor is assembled and which is caused to decrease in diameter when the locking ring is tightened on the body.

3. An adaptor as claimed in claim 2, wherein the compression element has a bevelled surface that bears on a bevelled surface of the body so that it is caused to decrease in diameter when the locking ring is tightened.

4. An adaptor as claimed in claim 2, wherein the compression member comprises a plurality of sub-members that are caused to move together when the locking ring is tightened.

5. An adaptor as claimed in claim 4, wherein the sub-members are held together by means of a deformable member.

6. An adaptor as claimed in claim 1, wherein the ferrules are resilently deformable so that they can be held in the recesses and removed therefrom repeatedly.

7. An adaptor as claimed in claim 6, wherein the ferrules have a slot extending along their length to allow them to deform.

8. An adpator as claimed in claim 1, wherein the ferrules are each provided with a device for forming an electrical connection to the screen of the wires or wires.

9. An adaptor as claimed in claim 8, wherein the device for forming an electrical connection to the screen is a dimensionally heat-recoverable sleeve that contains a quantity of solder.

* * * * *